US005954223A

United States Patent [19]

Moore

[11] Patent Number: 5,954,223

[45] Date of Patent: Sep. 21, 1999

[54] MOLDED ARTICLE

[75] Inventor: Richard L. Moore, Fairhope, Ala.

[73] Assignee: The Lerio Corporation, Mobile, Ala.

[21] Appl. No.: 08/962,714

[22] Filed: Nov. 3, 1997

[51] Int. Cl.[6] ..... B65D 41/00

[52] U.S. Cl. ..... 220/659; 220/657

[58] Field of Search ..... 220/659, 655, 220/657, 658, 720

[56] References Cited

U.S. PATENT DOCUMENTS

| | | | |
|---|---|---|---|
| D. 256,682 | 9/1980 | Lee et al. | D11/152 |
| D. 260,751 | 9/1981 | Lee et al. | D11/155 |
| D. 269,643 | 7/1983 | Hartman et al. | D34/7 |
| D. 271,247 | 11/1983 | Lee | D34/7 |
| D. 298,303 | 11/1988 | Lee | D11/152 |
| 3,250,429 | 5/1966 | Gesell | 220/72 |
| 3,268,144 | 8/1966 | Gaunt | 229/2.5 |
| 3,975,860 | 8/1976 | Harned et al. | 47/38.1 |
| 4,106,235 | 8/1978 | Smith | 47/59 |
| 4,177,934 | 12/1979 | Hammes et al. | 220/319 |
| 4,228,122 | 10/1980 | Hammes | 264/534 |
| 4,228,911 | 10/1980 | Hammes | 220/1 R |
| 4,236,353 | 12/1980 | Sorenson | 47/81 |
| 4,257,527 | 3/1981 | Snyder et al. | 220/72 |
| 4,367,821 | 1/1983 | Holt | 220/657 X |
| 4,378,328 | 3/1983 | Przytulla et al. | 264/534 |
| 4,418,829 | 12/1983 | Clay | 220/74 |
| 4,466,552 | 8/1984 | Butterworth et al. | 220/354 |
| 4,479,751 | 10/1984 | Wyman et al. | 414/406 |
| 4,513,872 | 4/1985 | Bull | 220/658 |
| 4,529,570 | 7/1985 | Przytulla | 264/534 |
| 4,643,323 | 2/1987 | Schutz | 220/72 |
| 4,674,648 | 6/1987 | Przytulla | 220/72 |
| 4,715,144 | 12/1987 | Lee | 47/66 |
| 4,878,592 | 11/1989 | Lee | 220/23.83 |
| 4,898,296 | 2/1990 | Burgdorf et al. | 220/72 |
| 4,972,963 | 11/1990 | Guarriello et al. | 220/72 |
| 5,007,135 | 4/1991 | Rigsby | 47/73 |
| 5,026,268 | 6/1991 | Lee | 425/525 |
| 5,044,923 | 9/1991 | Przytulla | 425/525 |
| 5,240,138 | 8/1993 | Gallagher | 220/658 |
| 5,253,996 | 10/1993 | Moore | 425/525 |
| 5,279,070 | 1/1994 | Shreckhise et al. | 47/39 |
| 5,282,736 | 2/1994 | Moore | 425/525 |
| 5,364,675 | 11/1994 | Guarriello et al. | 428/35.7 |
| 5,503,886 | 4/1996 | Guarriello et al. | 428/35.7 |

FOREIGN PATENT DOCUMENTS 1453443 9/1966 France .

*Primary Examiner*—Steven Pollard

*Attorney, Agent, or Firm*—Roylance, Abrams, Berdo & Goodman, L.L.P.

[57] ABSTRACT

An article, such as a container, includes a bottom wall, a sidewall and rim around a top end to strengthen the sidewall and to provide a handle for lifting the article. The rim includes a first lip extending radially outward with respect to the container to provide strength and rigidity to the rim and sidewall. The first lip is formed by two substantially parallel layers of material that can be spaced apart or bonded together. A second flexible lip extends radially from the rim and is axially spaced from the first lip. The second lip forms a continuous open channel enabling the second lip to be gripped from the inside of the article. The second lip has a radial dimension greater than the first lip to limit contact of the first lip with an adjacent object. An article is made by a blow molding process and apparatus having moving segment molds. A thermoplastic parison is inflated to contact the mold surfaces. The moving mold segments then compress a portion of the plastic to form the first lip.

35 Claims, 7 Drawing Sheets

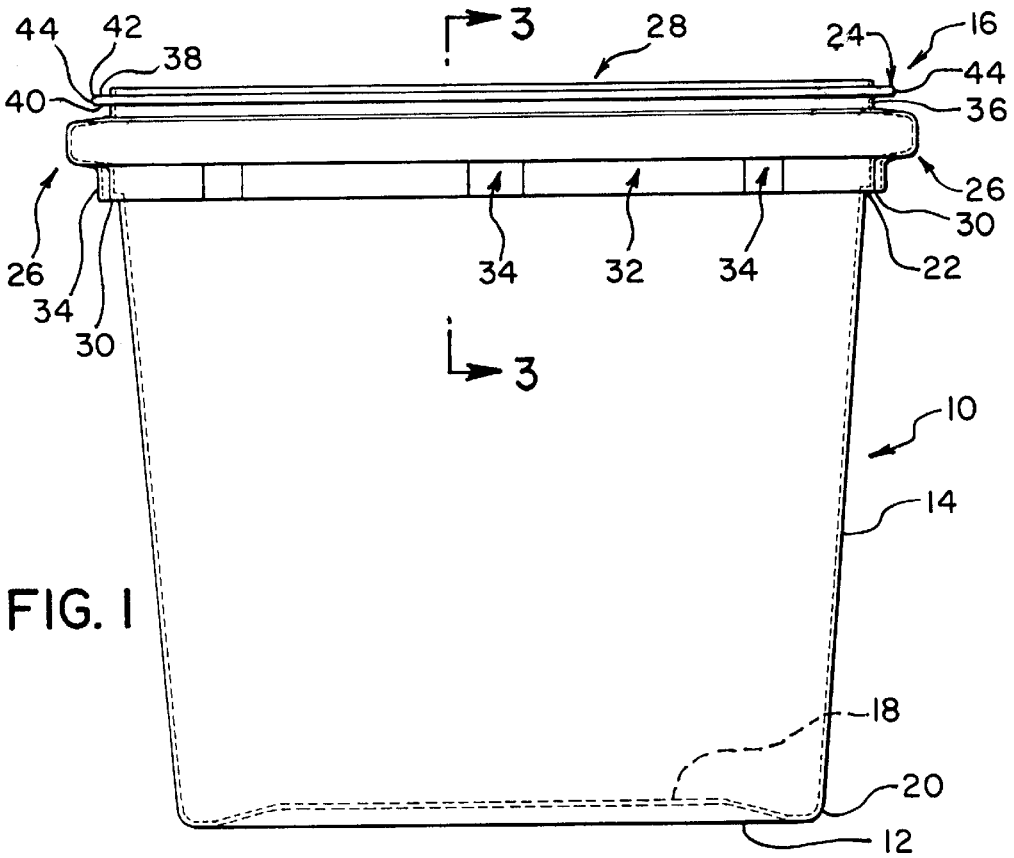
FIG. 1
FIG. 2
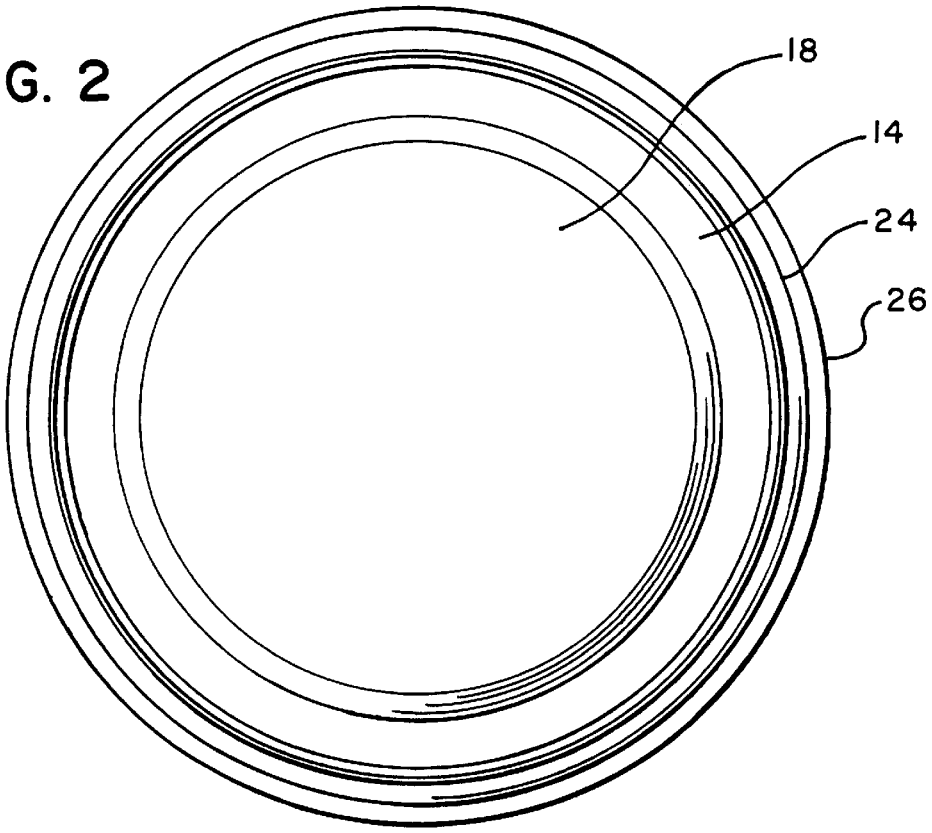

MOLDED ARTICLE

FIELD OF THE INVENTION

The present invention is directed to a molded article, and particularly to a blow molded nursery container having a molded strengthening rim structure. The invention is further directed to a blow molding process and apparatus for producing a molded container having a strengthening rim.

BACKGROUND OF THE INVENTION

Although containers can be made from a variety of materials, thermoplastic resins have achieved widespread acceptance over the last several decades. Molded thermoplastic containers and other articles are desirable for many applications due in part to the low cost and durability of the thermoplastic resin.

Several processes are commonly used to mold various articles from thermoplastic resins. The most common processes include injection molding, extrusion molding and blow molding. Each molding process has unique characteristics which can make the process more suitable for certain applications. Similarly, each process has disadvantages for molding certain types or shapes of articles. For example, injection molding processes are more suitable for making open containers where a thick wall is needed or where the thickness of the container is required to vary at different locations.

The primary disadvantages of injection molding processes are the increased amount of resin used to mold the container and the longer molding cycle time compared to other molding processes. These disadvantages increase the production costs of the container. However, an advantage of injection molded containers is the ability to easily control the wall thickness and the strength of the container in a manner that cannot always be obtained by other processes.

Blow molding of thermoplastic resins to make hollow articles such as containers has several advantages over other processes. For example, the blow molding processes are generally faster than some other processes, such as injection molding, thereby increasing the output capacity of the mold. The thickness of the molded resin can be made comparatively thin to reduce the cost of material in the finished article.

Blow molded containers having corrugated ribs at the top end to provide some rigidity to the container wall are common. Examples of such blow molded containers are found in U.S. Pat. No. 4,715,144 to Lee. This type of container is generally quite flexible and is not able to withstand lateral forces.

In an effort to strengthen the rim and sidewalls of the typical blow molded container, several processes have been proposed. Many of these processes utilize blow molding with moving section molds to reshape the plastic after the parison is inflated to contact the inside mold surface. The moving segments generally reshape the plastic by bending or folding the plastic while still soft. There are a number of blow molding processes which use moving section molds to fold two layers of the hot plastic over on each other and compress the hot plastic layers together. It is generally desirable to compress the plastic layers together while the plastic is still sufficiently hot so that the layers weld together. These processes typically result in a lip having greater thickness and stiffness than the remaining portions of the molded article. Examples of this type of molding process and apparatus with movable mold sections are found in U.S. Pat. No. 4,428,122 to Hammes.

Another example of a blow molding process and apparatus is disclosed in U.S. Pat. Nos. 4,972,963, 5,364,675 and 5,503,886 to Guarriello et al. The apparatus requires a number of moving mold segments which move at different and carefully controlled speeds and travel different distances to make a hollow blow molded lip. The resulting container has a tubular shaped lip encircling the open end. The tubular shaped lip is made by pinching portions of the plastic together to enclose the hollow area. Another example of a blow molded container having a hollow rim where portions of the overlapping layers are welded together is disclosed in U.S. Pat. No. 4,643,323 to Schutz.

The containers produced by the above-noted processes typically have a rigid lip providing structural integrity to the container. In some applications, such as, for example, in the nursery industry, a rigid container is desirable for lifting and stacking. A rigid lip on a nursery container has the distinct disadvantage of being sharp which can scrape and damage the bark of a plant in an adjacent container.

A lip on large nursery containers assists in lifting and carrying the nursery container. Handles formed on the inside surface of the nursery container are also advantageous in carrying large containers. Many blow molded nursery containers having inside handles do not have reinforced rims so that the container lacks structural integrity. Examples of nursery containers having a strengthening reinforced lip and having inside handles for lifting containers are disclosed in U.S. Pat. Nos. Des. 361,956 and Des. 338,636 to Moore. These containers are sufficiently rigid for lifting by the inside handle when full. However, the lips are hard and can damage the plant in an adjacent container when plants are stacked for transporting.

Accordingly, a continuing need exists in the industry for improved containers which overcome the limitations of the prior containers.

SUMMARY OF THE INVENTION

The present invention is directed to an article and particularly to a nursery container made by a blow molding process.

Accordingly, a primary object of the invention is to provide a container having sufficient strength to allow the container to be easily lifted and stacked while resisting collapsing of the container wall.

Another object of the invention is to provide a container having a strengthening rim formed by two layers of plastic material folded over on one another.

A further object of the invention is to provide a structurally sound plastic container having a flexible and resilient outer rim.

Still another object of the invention is to provide a plastic container having an inside handle formed by a continuous channel extending around the circumference of the container.

Another object of the invention is to provide a plastic container having a first stiff strengthening rim and second rim with a smooth outer surface to limit contact of the stiff rim with an adjacent object.

A further object of the invention is to provide a nursery container having a continuous, inwardly open channel forming an inside handle surrounding the top end of the container enabling the container to be gripped at all points around the top end.

Still another object of the invention is to provide a blow molding process and apparatus for producing a container having a flexible lip for lifting the container and a stiffening lip for providing strength to the container wall.

Another object of the invention is to provide a process and apparatus for manufacturing containers that is efficient and economical.

The foregoing objects of the invention are basically attained by providing a container comprising a bottom wall, a sidewall extending about a center axis, the sidewall having a bottom end coupled to the bottom wall and an open top end spaced from the bottom end, a continuous rim coupled to the top end of the sidewall, the rim including axially spaced first and second lips extending in a substantially radial direction with respect to the sidewall, the first lip being dimensioned to strengthen the sidewall and resist collapsing of the sidewall, the second lip forming a continuous channel around the sidewall, the channel having a continuous opening facing inwardly with respect to the container and having a radial dimension greater than a radial dimension of the first lip.

The objects of the invention are further attained by providing a container comprising a bottom wall, a substantially frustoconical sidewall having a bottom end coupled to the bottom wall, and having a top end spaced from the bottom end, a first lip coupled to the sidewall and extending radially outward with respect to a center axis of the container, the first lip having a top layer and a bottom layer integrally formed together and dimensioned to strengthen the sidewall, the first lip being substantially rigid to inhibit collapsing of the sidewall, and a second lip coupled to the sidewall and extending radially outward with respect to the center axis, the second lip having a top portion and a bottom portion spaced from the top portion to define a substantially continuous open channel around the container, the second lip having a substantially smooth and flexible outer edge spaced from the wall a distance greater than a radial dimension of the first lip, thereby limiting contact of the first lip with an adjacent object.

The foregoing objects are also attained by providing a bottom wall, a substantially frustoconical sidewall having a bottom end coupled to the bottom wall and a top end spaced from the bottom wall, a first lip integrally formed with and extending radially outward with respect to the sidewall a distance to strengthen the sidewall at an open top end of the container, the first lip including a substantially rigid top layer, and a substantially rigid bottom layer connected to the top layer, a second lip integrally formed with and extending completely around the sidewall and being axially spaced from the first lip, the second lip having a resilient top portion, a resilient bottom portion and an outer wall extending between outer edges of the top and bottom portions, the top and bottom portions being spaced apart a distance to form an open continuous channel dimensioned to enable a user to lift an inside edge of the top portion, the top and bottom portions extending radially outward from the sidewall a distance greater than a radial dimension of the first lip.

The objects, advantages and salient features of the invention will become apparent from the following detailed description, which taken in conjunction with the drawings, disclose preferred embodiments of the invention.

BRIEF DESCRIPTION OF THE DRAWINGS

Referring to the drawings which form a part of this disclosure:

FIG. 1 is a side elevational view of the container according to a first embodiment of the present invention;

FIG. 2 is a top plan view of the container of FIG. 1;

DETAILED DESCRIPTION OF THE INVENTION

Figure 3:
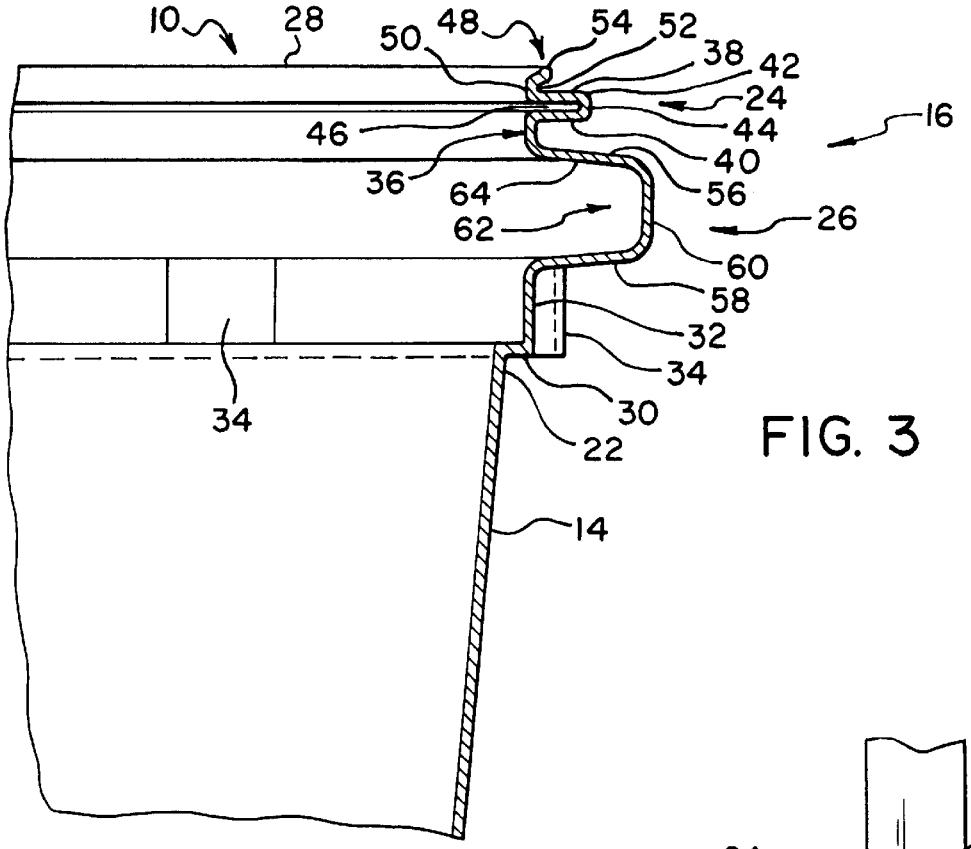
FIG. 3 is a partial side elevational view in section of the rim structure of the container of FIG. 1 taken along line 3—3 of FIG. 1.

The present invention is directed to an article, and particularly to a molded plastic container. Referring to the drawings, the container 10 includes a bottom wall 12, a sidewall 14, and a rim 16. In preferred embodiments of the invention, container 10 is a nursery container for growing and transporting plants.

Referring to FIGS. 1 and 2, bottom wall 12 has a generally circular shape with a raised section 18 to facilitate water drainage from the container when the container is used as a nursery container. Drainage holes (not shown) can be provided in the bottom wall 12 or in sidewall 14 to drain excess water from the container as in conventional nursery containers.

Sidewall 14 as shown in FIGS. 1 and 2 has a generally frustoconical shape converging toward bottom wall 12. A lower end 20 of sidewall 14 is integrally formed with bottom wall 12. A top end 22 of sidewall 14 is coupled to rim 16 at a completely open top end 28. In further embodiments, sidewall 14 can have a substantially cylindrical shape or polygon shape as known in the art. Sidewall 14 is preferably tapered toward the bottom wall 12 so that a plurality of the containers can be stacked or nested together during storage and shipping. Rim 16 as shown in FIG. 1 has a first strengthening lip 24 and a second lip 26. Rim 16 is preferably integrally formed with sidewall 14 and surrounds the entire open end 28 of container 10.

Rim 16 includes a lower shoulder 30 extending radially outward from the sidewall 14 and a substantially cylindrical side portion 32 perpendicular to shoulder 30. Semi-cylindrical shaped ribs 34 are formed integrally into cylindrical portion 32 to increase the strength of side portion 32 and rim 16. Ribs 34 are formed about an axis parallel to the longitudinal axis of container 10. A substantially cylindrical portion 36 extends between the first lip 24 and second lip 26.

In a first preferred embodiment of the invention shown in FIG. 31 first lip 24 is unitarily formed with rim 16 and includes a top layer 38 and a bottom layer 40 coupled together at their outer edges 42 by an end wall 44. Bottom layer 40 is coupled to cylindrical portion 36 and extends outwardly therefrom and in a radial direction with respect to the central or longitudinal axis of container 10. Top layer 38 is substantially parallel to bottom layer 40. In the embodiment illustrated in FIG. 3, top layer 38 and bottom layer 40 are spaced apart to form a gap 46 between the layers. Preferably, top layer 38 and bottom layer 40 are closely spaced so that gap 46 is less than the thickness of either top layer 38 or bottom layer 40. The width and length of the gap 46 is dependent on the dimensions of the molding apparatus and the amount of plastic material in the molding apparatus. Outer edges 42 of lip 24 can be compressed during the molding process as discussed hereinafter in greater detail to form a solid area of compressed plastic and a gap having a length less than the length of lip 24.

Top layer 38 and bottom layer 40 have a radial dimension sufficient to provide structural integrity to rim 16. First lip 24 is preferably sufficiently thick and wide enough to resist lateral forces from collapsing sidewall 14. A ridge 48 is coupled to an inner edge 50 of top layer 38 to further strengthen the rim 16. Ridge 48 includes a cylindrical portion 52 extending substantially perpendicular to top layer 38 and an outwardly extending portion 52. Outwardly extending portion 54, as shown in FIG. 3, extends less than the width of top layer 38 and extends in a slightly upward direction with respect to top layer 38.

In the embodiment illustrated, second lip 26 is unitarily formed with rim 16 and is positioned below first lip 24 with respect to the open top end 28. In alternative embodiments, second lip 26 can be positioned above first lip 24. Generally, it is preferred to have first lip 24 positioned above second lip 26 to increase the strength of container 10 for lifting at the open top end 28.

In the embodiment of FIG. 3, second lip 26 includes a top portion 56 extending radially outward from cylindrical flange 36 and a bottom portion 58 extending radially outward from cylindrical portion 32. In preferred embodiments, top portion 56 and bottom portion 58 converge slightly toward their outermost edges. Outer wall 60 extends between the outer edges of top portion 56 and bottom portion 58. In further embodiments, top portion 56 and bottom portion 58 are substantially parallel to each other.

As shown in FIG. 3, top portion 56, bottom portion 58 and outer wall 60 form a continuous channel shaped recess surrounding rim 16 and having an open end 62 on the inside of container 10. Outer wall 60 has an axial length to space top portion 56 from bottom portion 58 a sufficient distance to form a continuous handle accessible from the inside of container 10. Container 10 can be lifted by placing a lifter's fingers through opening 62 and on a bottom surface 64 of top portion 56, and then lifting upwardly. Opening 62 of second lip 26 surrounds the entire container 10 so that the container can be lifted at any point around the container perimeter.

Figure 4:
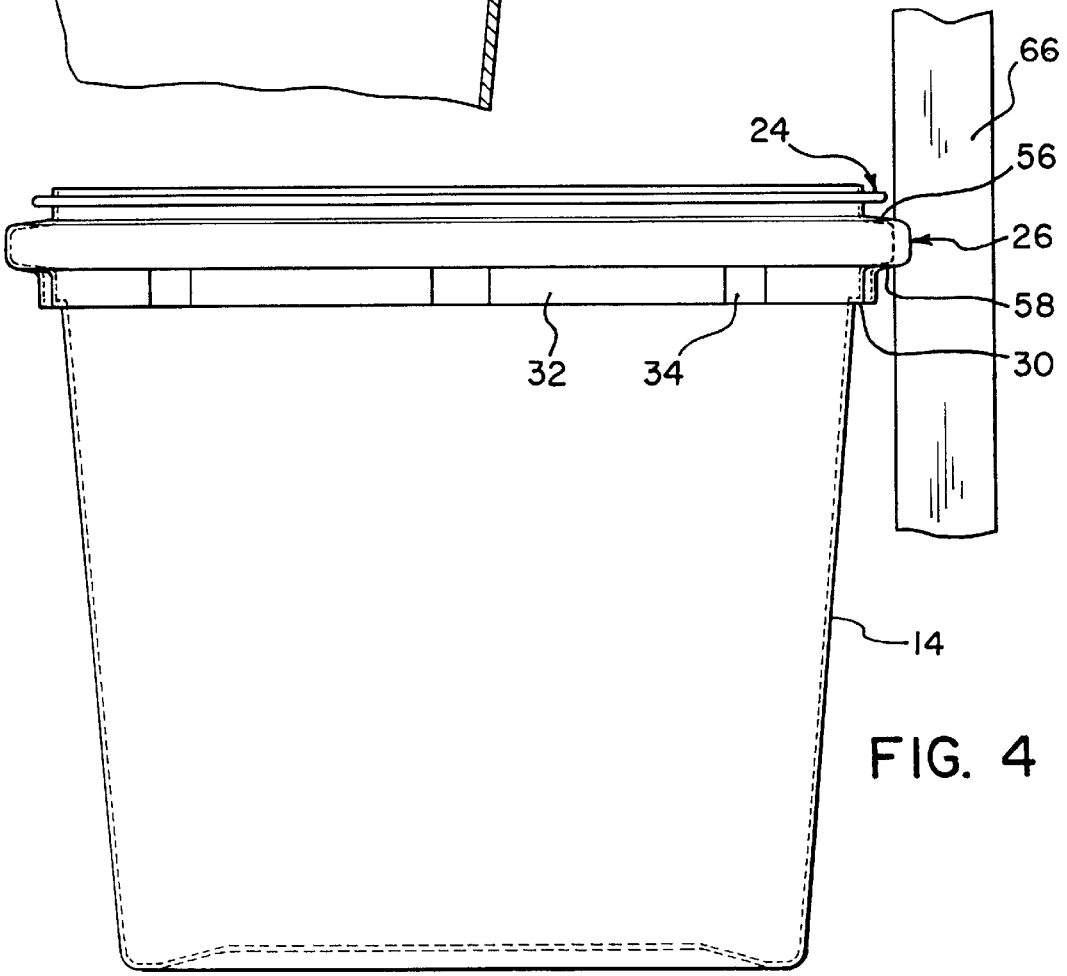
FIG. 4 is a side elevational view of the container of FIG. 1 showing the container of the rim contacting a stationary object.
Figure 5:
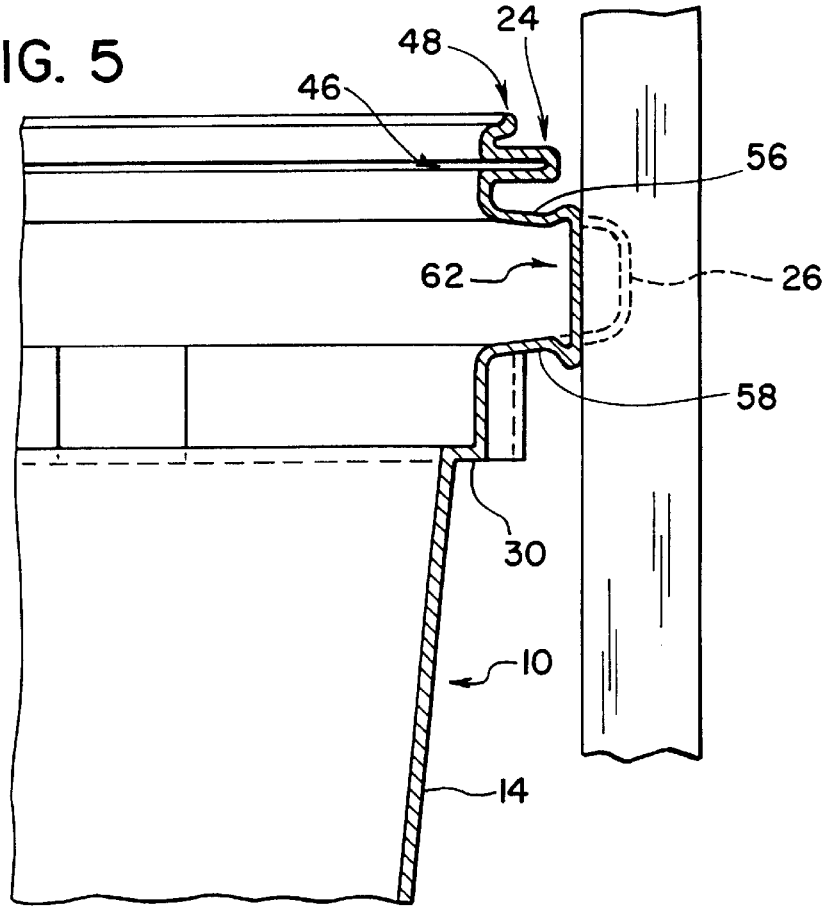
FIG. 5 is a partial side elevational view in section of the rim structure of the container of FIG. 4 showing the deflection of the rim when contacting a stationary object.

Top portion 56 and bottom portion 58 of second lip 26 preferably have a radial dimension greater than the radial dimension of first lip 24 so that lip 26 has a larger diameter than lip 24. Lip 26 is preferably sufficiently flexible to provide a cushion about container 10, while being sufficiently rigid to permit container 10 to be lifted. Referring to FIGS. 4 and 5, lip 26 is sufficiently flexible so that lip 26 can be deformed or compressed slightly when the lip 26 contacts a relatively rigid, stationary object, for example, a tree trunk 66 in an adjacent container. As shown in FIG. 5, top portion 56 and bottom portion 58 of lip 26 are able to flex and absorb the impact of lip 26 against tree trunk 66 to minimize damage to the tree. Outer wall 60 maintains a smooth surface to resist scraping of the tree trunk 66 and to prevent damage to its bark. Lip 26 has a greater radial dimension and extends further outwardly than lip 24 to prevent lip 24 from contacting tree trunk 66. Since lip 24 is generally stiff to provide strength to container 10, outer edges 42 of lip 24 are generally hard and sharp, and can scrape and damage the soft bark of a young tree trunk 66 if allowed to contact tree trunk 66. Lip 26 is sufficiently resilient and the plastic generally has a sufficient resilient memory to return to its original shape after the container is moved away from the tree or other object.

Figure 6:
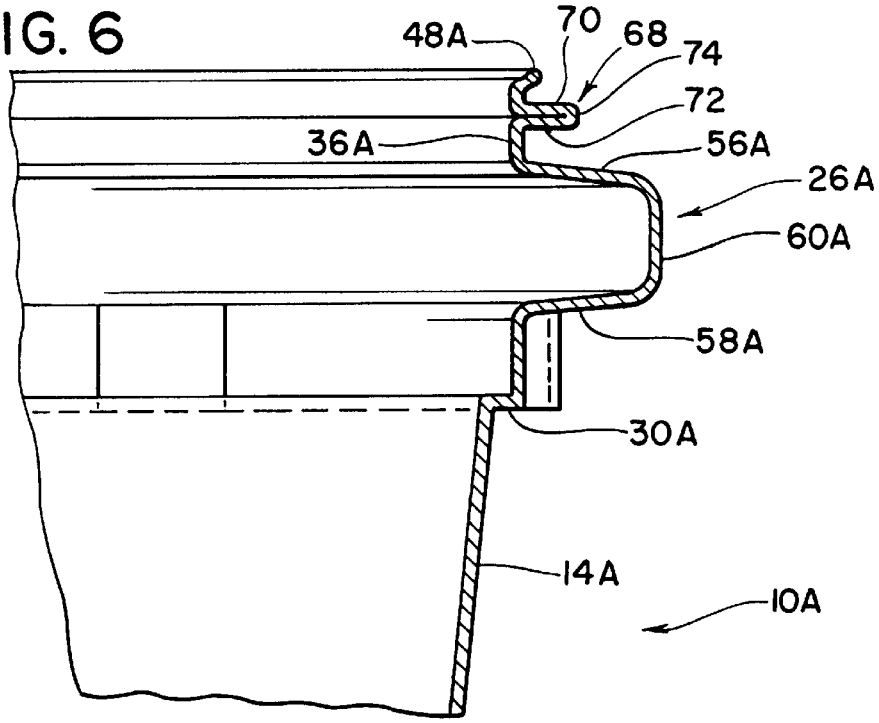
FIG. 6 is a partial side elevational view in section of the container rim according to a second embodiment of the present invention.

Referring to FIG. 6, a second embodiment of the invention is illustrated which is similar to the embodiment of FIGS. 1–5 with the exception of a strengthening lip 68. Accordingly, similar structural elements are identified by the same reference number with the addition of the letter "A". As shown in FIG. 6, lip 68 is formed by a top layer 70 and a bottom layer 72 connected together at an outer edge 74. Top layer 70 overlies bottom layer 72 so that essentially no gap or air space is provided between the layers. As in the previous embodiment, lip 26A has a radial dimension greater than the radial dimension of lip 68 to limit contact of lip 68 with an adjacent object.

Figure 7:
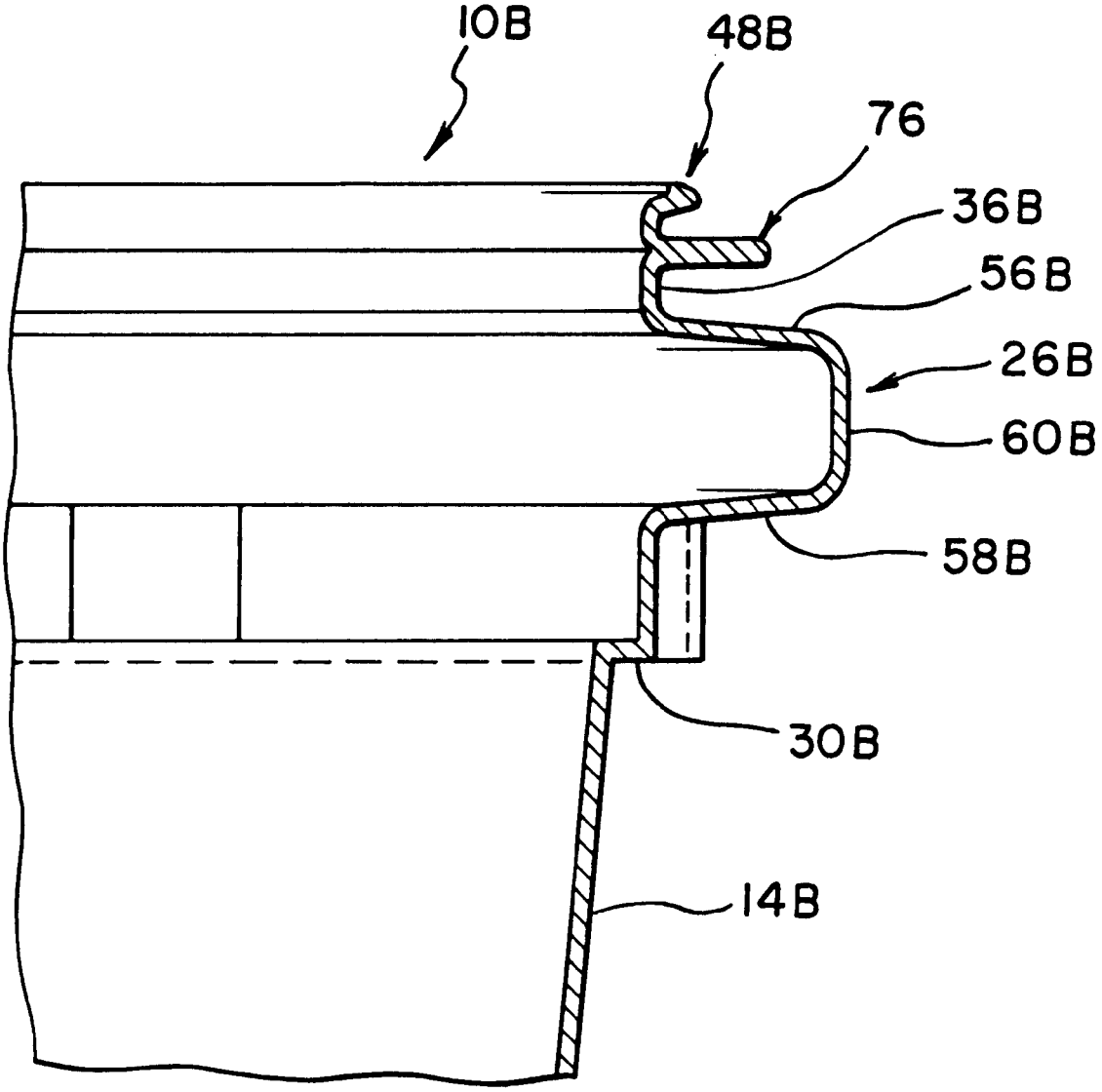
FIG. 7 is a partial side elevational view in section of the rim structure of a container according to a third embodiment of the present invention.

FIG. 7 illustrates a third embodiment of the invention similar to the embodiment of FIGS. 1–5, with the exception of the structure of strengthening lip 76. Accordingly, identical structural elements are identified by the same reference numeral with the addition of the letter "B". As shown in FIG. 7, strengthening lip 76 is essentially a single layer of material extending radially outward from container 10B. Lip 76 is preferably a solid layer formed by compressing and fusing two layers of hot plastic material together. Lip 76 preferably has a thickness substantially equal to the combined thickness of two layers of plastic material. Although lip 76 is illustrated as a solid layer, air can be entrapped in the lip 76 when the two layers of material are compressed together thereby forming small air pockets or bubbles.

Figure 8:
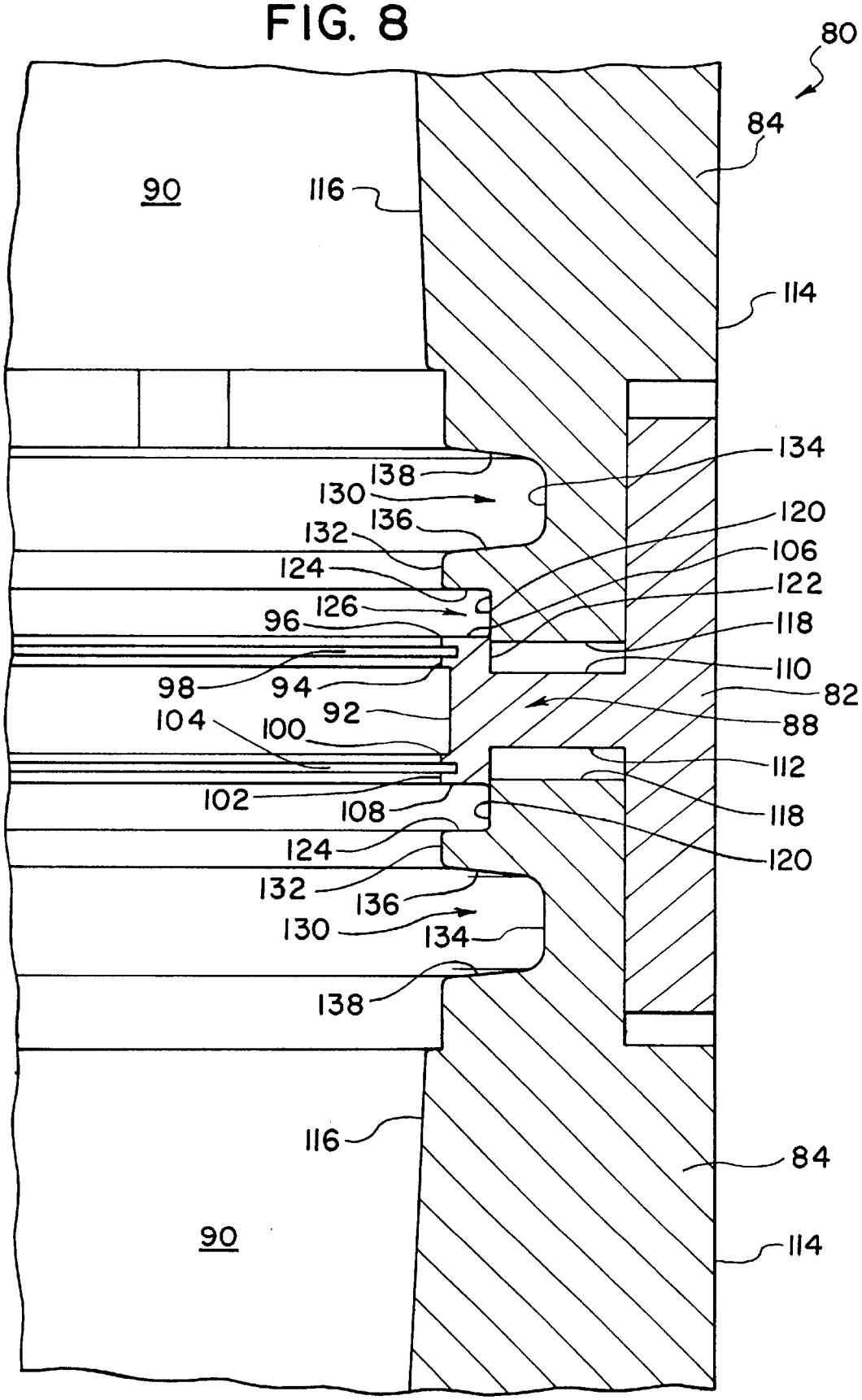
FIG. 8 is a partial side elevational view in section of a molding apparatus for producing the rim structure of the container of FIG. 1.
Figure 9:
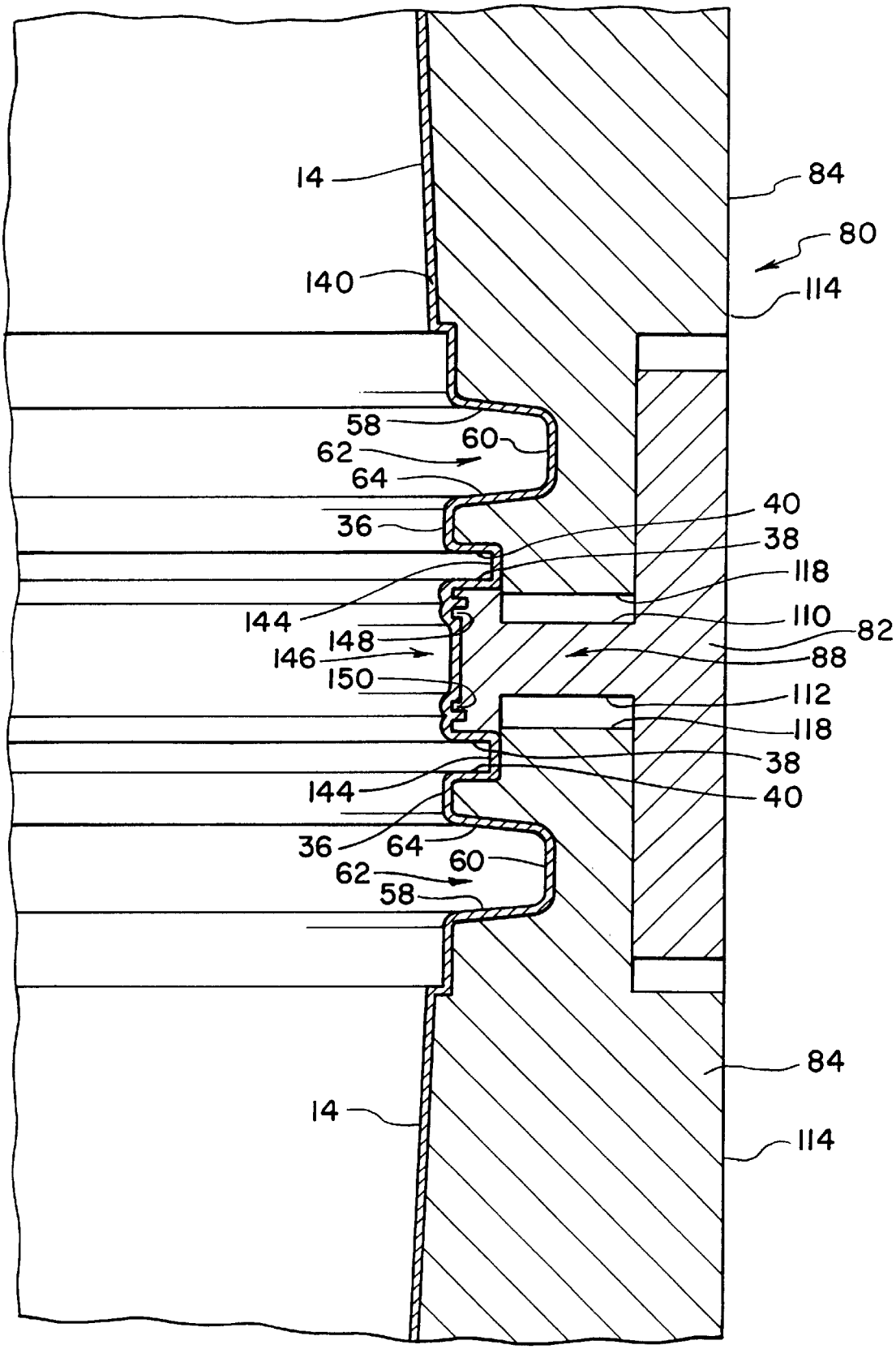
FIG. 9 is a partial side elevational view in section of the molding apparatus of FIG. 1, with the moving mold sections in a first position and a plastic parison inflated to conform to the mold surface.
Figure 10:
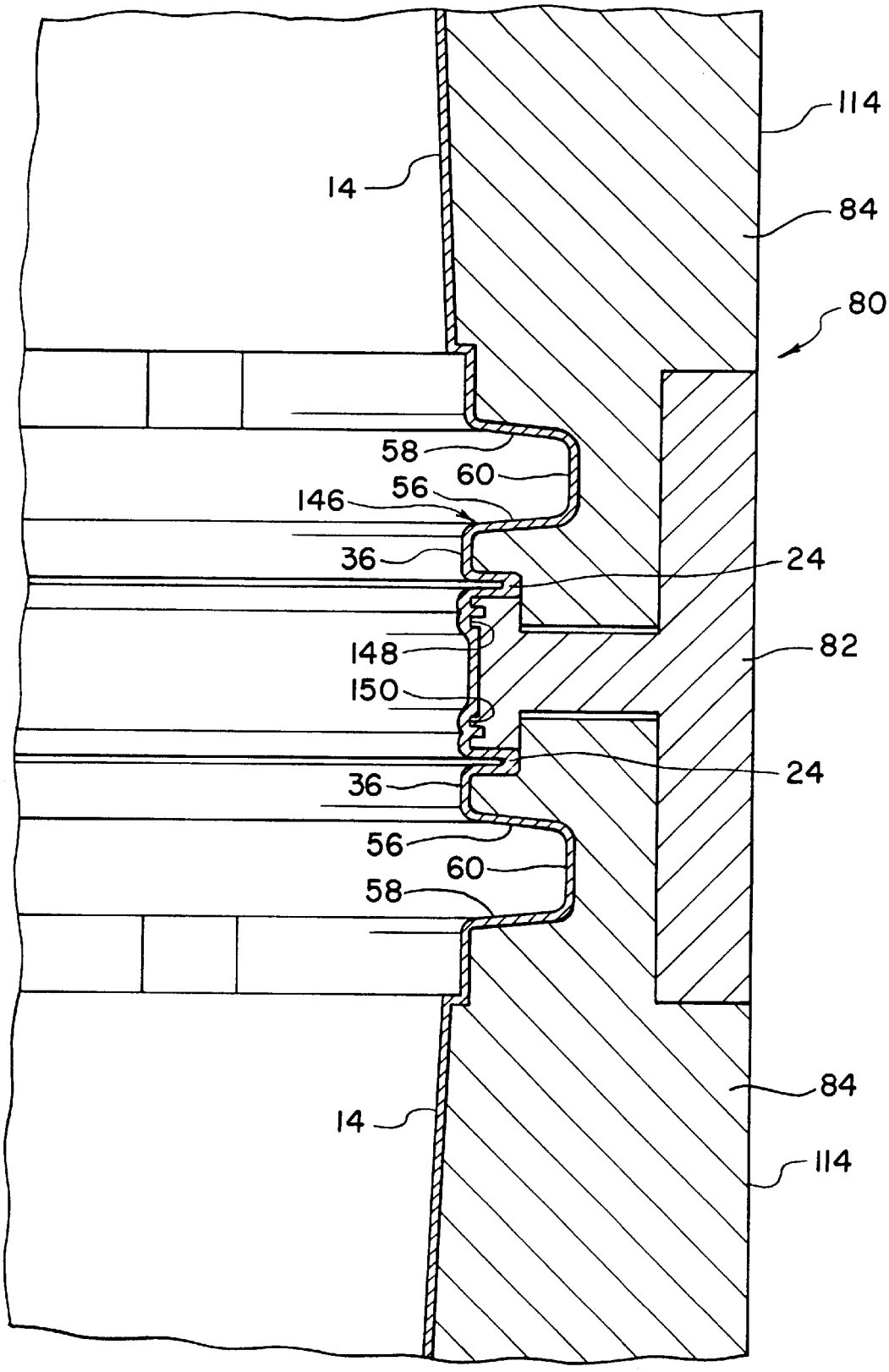
FIG. 10 is a side elevational view in section of the mold and parison of FIG. 9, showing the moving mold sections in a second position to form a strengthening rim.

In preferred embodiments of the invention, the containers are made by a blow molding process and molding apparatus having moving mold segments as shown in FIGS. 8–10. The molding process and molding apparatus are similar to the process and apparatus disclosed in U.S. Pat. No. 5,282,736 to Moore which is hereby incorporated by reference in its entirety. The molding apparatus includes two mold halves 80 having concave mold surfaces that move together to form a mold cavity. Each mold half 80 is substantially a mirror image of the other to form a substantially symmetrical molded article. In preferred embodiments of the invention, the containers are molded as a closed drum-like article which is then cut in half at a middle section to form two identical, completely open top containers as well known in the art.

FIGS. 8–10 illustrate a mold half 80 in cross-section at different times in the molding process. Each mold half 80 of the molding apparatus includes a center molding ring 82 that is retained in a fixed position throughout the molding process. Each mold half 80 also includes upper and lower moving mold segments 84. Each mold half 80 further includes an end segment (not shown) cooperating with moving mold segments 84 to mold the bottom of the container.

FIG. 8 shows center ring 82, and upper and lower moving mold segments 84. Moving mold segments 84 are substantially identical to one another to mold a substantially symmetrical hollow article. As shown in FIG. 8, center ring 82 includes an annular extension 88 extending radially inward toward the mold cavity 90. Annular extension 88 includes an annular face 92 having a first pair of substantially parallel annular ridges 94 and 96 forming an annular groove 98 at a first axial end. A second pair of annular ridges 100, 102 at a second axial end of annular face 92 form a second annular groove 104. Annular extension 88 includes an upper axial surface 106 and a lower axial surface 108 adjacent ridge 96 and ridge 102, respectively. An upper annular recess 110 is formed in annular extension 88 adjacent upper axial surface 106. A lower annular recess 112 is also formed in adjacent lower axial surface 108.

Referring to FIG. 8, moving mold sections 84 include an outer surface 114 and an inner mold surface 116. Each moving mold segment 84 has an axial end 118 facing a direction parallel to a longitudinal axis of mold segments 84 and the resulting molded article. The axial end 118 has a shape complementing upper annular recess 100 of center ring 82. Axial end 118 includes an inwardly facing radial surface 120 parallel to the longitudinal axis for engaging and sliding against a sidewall 122 of annular recess 110 during axial movement of movable mold sections 84 as discussed hereinafter in greater detail. An axial mold surface 124 is positioned adjacent radial surface 120 and facing axial surfaces 106, 108 of center ring 82. As shown in FIG. 8, axial surfaces 124 of mold segments 84, axial surfaces 106, 108 of center ring 82 and slide surface 120 define annular recesses 124 within the mold cavity 40.

An annular recess 130 formed in each moving mold segment 84 is axially spaced from axial face 124 as shown in FIG. 8. A radial section 132 extends axially from axial face 124 to annular recess 130. In the embodiments shown in FIG. 8, annular recess 130 has a radial dimension about twice the radial dimension of axial face 124.

Annular recess 130 is preferably dimensioned to form an annular open channel in the molded article where the channel has a sufficient depth and width for gripping the inside and the outside of the molded article. As shown in FIG. 8, annular recess 130 has an end wall 134 and sidewalls 136, 138. In preferred embodiments as shown in FIG. 8, sidewalls 136, 138 converge slightly from inner mold surface 116 to end wall 134. The converging sidewalls 136, 138 allow easy removal of the molded article from the mold surface. In alternative embodiments, sidewalls 136, 138 can be substantially parallel to each other.

In the molding process of the invention, the moving mold segments 84 are initially in an axially retracted position with respect to center ring 82 as shown in FIG. 8. Referring to FIG. 9, a hot plastic parison 140 is introduced into the mold and the mold halves closed around the parison as known in the art. The parison 140 is inflated under air pressure to conform parison 140 to the molding surface 116 of the mold. Standard air pressures can be used as known in the art which typically range from about 80–120 psi. As shown in FIG. 9, the hot plastic parison 140 conforms to the mold surfaces to produce annular channels 62 formed by annular recess 130 of moving mold sections 84. The air pressure further forces the plastic material into the annular recesses 126 defined between axial faces 124 of moving mold segments 84 and axial faces 106 and 108 of center ring 82 to form molded annular channels 144. The parison 140 is also forced into the annular grooves 98 and 104 of center ring 82 to form splitting grooves 148, 150. After the parison 140 has conformed to the mold surface, moving mold segments 84 are moved axially toward center ring 82 as shown in FIG. 10. During the axial movement of moving mold segments 84, the plastic material in the annular recesses 126 is compressed as shown in FIG. 10 to form strengthening lip 24.

Moving mold segments 84 are operated by pneumatic or hydraulic cylinders (not shown) for moving mold segments 84 axially with respect to center ring 82. The hydraulic pressure forces moving mold segments 84 simultaneously toward center ring 82 to compress parison 140 in annular recesses 126 to deform the plastic and form a molded article 146. Moving mold segments 84 are retained in the position shown in FIG. 10 for sufficient time to allow parison 140 to cool sufficiently to retain its shape. At that time, the hydraulic pressure to the cylinders which operate moving mold segments 84 is released to relieve the molding pressure against center ring 82 and the molding pressure of axial face 124 against axial faces 106, 108. The mold halves are then separated to open the mold and the molded article is removed. It is desirable to release the hydraulic pressure of the operating cylinders of moving mold segments 84 without retracting the moving mold segments until the molded article is removed from the mold. Retracting the moving mold segments 84 to the position shown in FIG. 8 before the molded article is removed will cause undesirable stretching of the plastic material and separation of layers of plastic material.

In further embodiments, parison 140 is inflated at relatively low air pressure of about 40–60 psi to expand the parison into contact with center ring 82 and into recesses 126. Moving mold segments 84 are then moved toward center ring 82 to compress the plastic in recesses 126. Thereafter, the parison is inflated at a pressure of about 80–120 psi to fully conform the parison to the molding surfaces.

The molded article 146 has center portion with a configuration substantially as shown in FIG. 10. The article 146 is cut along splitting grooves 148 and 150 to produce two substantially identical containers as shown in FIG. 1. As shown in FIG. 10, axial faces 124 and axial faces 106 and 108 compress the plastic material to form the first lip 24 of the container 10 of FIG. 1. The annular recess 130 forms the second lip 26 of container 10. The thickness of lip 24 is dependent on the amount of plastic forced between the axial faces 124 and axial faces 106, 108 and the length of axial movement of the moving mold segments 84. Increasing the thickness of the parison 140 introduced to the mold will provide more plastic between the axial faces so that the axial movement of the moving mold segments 84 compress the plastic to form a substantially solid lip as shown in FIG. 7. A thin parison will compress the plastic between the axial faces 110 and 112 to form a solid outer edge of lip 24 and a slight gap between the layers adjacent the innermost edge as in the embodiment of FIG. 1. When the parison is allowed to cool below the melting temperature of the plastic before the moving mold segments compress the plastic, a lip having layers of plastic that are not fused together is generally formed as in the embodiment of FIG. 6.

While several embodiments have been shown to illustrate the invention, it will be understood by those skilled in the art that various changes and modifications can be made therein without departing from the scope of the invention as defined in the appended claims.

What is claimed is:

1. A container comprising:

a bottom wall;

a sidewall extending about a center axis, said sidewall having a bottom end coupled to said bottom wall and an open top end spaced from said bottom end; and a continuous rim coupled to said top end of said sidewall, said rim including axially spaced first and second lips extending in a substantially radial direction with respect to said sidewall, said first lip being substantially flat and dimensioned in said radial direction to strengthen said sidewall and resist collapsing of said sidewall, said second lip forming a continuous channel around said sidewall, said channel having a continuous opening facing inwardly with respect to said container and having a radial dimension greater than a radial dimension of said first lip, said second lip being resilient and compressible to absorb impact from an object and resist contact of said first lip with said object;

said container being made from a plastic material by blow molding.

2. The container of claim 1, wherein said first lip further comprises a top layer extending radially outward with respect to said sidewall, and a bottom layer substantially parallel to said top layer and having an outer edge coupled to said top layer at outer edges thereof and an inner edge coupled to a top end of said second lip.

3. The container of claim 2, wherein said top and bottom layers are welded together substantially along the width of said top and bottom layers.

4. The container of claim 2, wherein said top and bottom layers are layers of plastic material bonded together to form an integral layer, whereby said first lip has a thickness substantially equal to a combined thickness of said top and bottom layers.

5. The container of claim 2, wherein a substantially cylindrical portion extends substantially parallel to said center axis from an inside edge of said bottom layer of said first lip to an inside edge of said second lip.

6. The container of claim 2, wherein said top and bottom layers are spaced apart.

7. The container of claim 1, wherein said second lip is positioned between said first lip and bottom wall of said container.

8. The container of claim 1, wherein said first lip is substantially rigid.

9. The container of claim 1, wherein said open top end has a dimension substantially equal to a dimension of a top end of said side wall and said second lip comprises a radially extending top portion, and a radially extending bottom portion spaced from said top portion a distance to form a handle and enable a user to grip said second lip through said open channel for lifting said container.

10. The container of claim 9, wherein said second lip further comprises an outer portion connecting an outer edge of said top portion to an outer edge of said bottom portion and extending substantially parallel to said center axis.

11. The container of claim 1, wherein said sidewall has a substantially frustoconical shape.

12. The container of claim 1, wherein a ridge extends from an inside edge of said top layer of said first lip in a substantially axial direction away from said bottom wall.

13. A container having a substantially closed bottom end and an open top end comprising a bottom wall;

a substantially frustoconical sidewall having a bottom end coupled to said bottom wall, and having a top end spaced from said bottom end;

a first lip coupled to said sidewall and extending radially outward with respect to a center axis of said container, said first lip having a top layer and a bottom layer integrally formed together and dimensioned to strengthen said sidewall, said bottom layer being coupled to said sidewall, and said first lip being substantially rigid to inhibit collapsing of said sidewall; and a second lip coupled to said sidewall and extending radially outward with respect to said center axis, said second lip having a top portion and a bottom portion spaced from said top portion to define a substantially continuous open channel around said container, said second lip having a substantially smooth and flexible outer edge extending substantially parallel to said center axis and being spaced from said wall a distance greater than a radial dimension of said first lip, thereby limiting contact of said first lip with an adjacent object, wherein said container is made from plastic material by blow molding.

14. The container of claim 13, wherein said first lip encircles said container and is positioned between said top end and said second lip.

15. The container of claim 13, wherein said top and bottom layers of said first lip are coupled together at outermost edges thereof and wherein said top and bottom layers of said first lip have inner edges substantially aligned with inner edges of said top and bottom portion of said second lip.

16. The container of claim 15, wherein said top and bottom layers of said first lip are bonded together at least at one location.

17. The container of claim 15, wherein said top and bottom layers of said first lip are spaced apart.

18. The container of claim 15, wherein said top and bottom layers of said first lip are contiguous whereby said first lip has a thickness substantially equal to the combined thickness of said top and bottom layers.

19. The container of claim 13, wherein said top and bottom portions of said second lip are spaced apart a distance whereby said channel forms a handle accessible from an inside surface of said container.

20. The container of claim 13, wherein said second lip includes an outer portion defining said outer edge, wherein said outer portion is coupled to an outermost edge of said top portion and to an outermost edge of said bottom portion.

21. The container of claim 20, wherein said top and bottom portions of said second lip converge toward said outer portion.

22. The container of claim 13, further comprising a substantially cylindrical portion coupled to an inner edge of said bottom layer of said first lip to an inner edge of said top portion of said second lip, whereby said inner edge of said bottom layer of said first lip is axially aligned with said inner edge of said top portion of said second lip.

23. A container having a substantially closed bottom end and an open top end comprising:

a bottom wall;

a substantially frustoconical sidewall having a bottom end coupled to said bottom wall and a top end spaced from said bottom wall;

a first lip integrally formed with and extending radially outward with respect to said sidewall to strengthen said sidewall and being positioned at an open top end of said container, said first lip including a substantially rigid top layer, and a substantially rigid bottom layer connected to said top layer and to said sidewall;

a second lip integrally formed with and extending completely around said sidewall and being axially spaced from said first lip, said second lip having a resilient top portion, a resilient bottom portion and an outer wall extending between outer edges of said top and bottom portions, said top and bottom portions being spaced apart a distance to form an open continuous channel dimensioned to define a continuous handle to enable a user to lift an inside edge of said top portion, said top and bottom portions extending radially outward from said sidewall a distance greater than a radial dimension of said first lip.

24. The container of claim 23, wherein said first lip is positioned between said top end of said wall and said second lip.

25. The container of claim 23, said sidewall further comprising a substantially cylindrical portion coupling said first lip to said second lip.

26. The container of claim 25, wherein said cylindrical portion is coupled to an inner edge of said first lip and an inner edge of said second lip.

27. The container of claim 23, wherein said top and bottom layers of said first lip contact each other whereby said first lip has a thickness substantially equal to a combined thickness of said top and bottom layers.

28. The container of claim 27, wherein said top and bottom layers are bonded together.

29. The container of claim 23, wherein said top and bottom layers of said first lip are spaced apart at an inner edge of said first lip.

30. A container having an open top end comprising:

a bottom wall;

a substantially frustoconical sidewall having a bottom end coupled to said bottom wall and a top end spaced from said bottom wall, said sidewall diverging outwardly with respect to a center axis of said container toward said open top end;

a rim coupled to said top end of said sidewall and being coaxial with said center axis, said rim having a first and a second cylindrical portion, said second cylindrical portion being coupled to said sidewall and being coaxial with said center axis;

a first lip integrally formed with said first cylindrical portion and extending radially outward with respect to said first cylindrical portion and said sidewall to strengthen said sidewall at said open top end of said container, said first lip including a substantially rigid top layer, and a substantially rigid bottom layer connected to an outer edge of said top layer, said bottom layer having an inner edge connected to a top edge of said first cylindrical portion;

a second lip integrally formed with said second cylindrical portion and extending completely around said sidewall and being axially spaced from said first lip, said second lip having a resilient top portion having an inner edge coupled to said first cylindrical portion, a resilient bottom portion and an outer wall extending between outer edges of said top and bottom portions, said bottom portion having an inner edge coupled to said second cylindrical portion, said top and bottom portions being spaced apart a distance to form an open continuous channel dimensioned to enable a user to lift an inside edge of said top portion, said top and bottom portions of said second lip extending radially outward from said first and second cylindrical portions a distance greater than a radial dimension of said first lip, wherein said container is made from a plastic material by blow molding.

31. The container of claim 30, wherein inner edges of said first and second lips are axially aligned.

32. The container of claim 30, wherein said second lip has a radial width greater than a radial width of said first lip.

33. The container of claim 30, wherein said open top end of said container has a diameter greater than a diameter of said bottom wall.

34. The container of claim 30, wherein said second lip is sufficiently resilient to absorb impact upon contact with an adjacent object and resist contact of said first lip with said object.

35. The container of claim 30, wherein said top and bottom layers of said first lip are substantially flat.

* * * * *